US005386700A

United States Patent [19]

Hyde

[11] Patent Number: 5,386,700

[45] Date of Patent: * Feb. 7, 1995

[54] LIQUID PRESSURE AMPLIFICATION WITH SUPERHEAT SUPPRESSION

[76] Inventor: Robert E. Hyde, 18448 SE. Pine St., Portland, Oreg. 97233-4859

[ * ] Notice: The portion of the term of this patent subsequent to Sep. 29, 2009 has been disclaimed.

[21] Appl. No.: 207,287

[22] Filed: Mar. 7, 1994

Related U.S. Application Data

[62] Division of Ser. No. 948,300, Sep. 21, 1992, Pat. No. 5,291,744, which is a division of Ser. No. 666,251, Mar. 8, 1991, Pat. No. 5,150,580.

[51] Int. Cl.[6] ..... F25B 41/04

[52] U.S. Cl. ..... 62/224; 62/511; 62/197; 62/196.3; 62/DIG. 2; 62/DIG. 17

[58] Field of Search ..... 62/86, 216, 197, 196.3, 62/196.4, DIG. 2, 498, 511, DIG. 17, 224, 222

[56] References Cited

U.S. PATENT DOCUMENTS

| | | | |
|---|---|---|---|
| 1,946,328 | 2/1934 | Neff | 62/DIG. 2 |
| 2,967,410 | 1/1961 | Schultze | 62/511 |
| 4,419,865 | 12/1983 | Szymazek | 62/DIG. 2 |
| 4,599,873 | 7/1986 | Hyde | 62/498 |
| 5,097,677 | 3/1992 | Holtzapple | 62/500 |
| 5,150,580 | 9/1992 | Hyde | 62/86 |
| 5,291,744 | 3/1994 | Hyde | 62/86 |

FOREIGN PATENT DOCUMENTS

| | | | |
|---|---|---|---|
| 0247963 | 7/1987 | Germany | 62/DIG. 2 |

*Primary Examiner*—John M. Sollecito

*Attorney, Agent, or Firm*—Marger, Johnson, McCollom & Stolowitz

[57] ABSTRACT

Liquid pressure amplification with superheat suppression is used in an air-conditioning or refrigeration system which includes a compressor, a condenser, an expansion valve, and an evaporator, interconnected by conduits in a closed refrigerant loop. A first conduit coupling an outlet of the compressor to an inlet to the condenser. A centrifugal pump is coupled to the condenser (or receiver) outlet for boosting the pressure of the condensed liquid refrigerant by a substantially constant increment. A second conduit transmits a first portion of the condensed liquid refrigerant from outlet of the pump through the expansion valve into the evaporator to effect cooling. A third conduit transmits a second portion of the condensed liquid refrigerant from the pump outlet into the condenser inlet, which cools the superheated vapor refrigerant entering the condenser, reducing head pressure.

12 Claims, 3 Drawing Sheets

LIQUID PRESSURE AMPLIFICATION WITH SUPERHEAT SUPPRESSION

This is divisional application of U.S. Ser. No. 07/948,300, filed on Sep. 21, 1992, now U.S. Pat. No. 5,291,744, issued Mar. 8, 1994, which is a divisional application of U.S. Ser. No. 07/666,251, filed Mar. 8, 1991, now U.S. Pat. No. 5,150,580, issued Sep. 29, 1992.

BACKGROUND AND SUMMARY OF THE INVENTION

This invention relates generally to refrigeration and operation and more particularly to a method and apparatus for boosting the cooling capacity and efficiency of air-conditioning systems under a wide range of ambient atmospheric conditions.

In air conditioning, the basic circuit is essentially the same as in refrigeration. It comprises an evaporator, a condenser, an expansion valve, and a compressor. This, however, is where the similarity ends. The evaporator and condenser of an air conditioner will generally have less surface area. The temperature difference $\Delta T$ between condensing temperature and ambient temperature is usually 27° F. with a 105° F. minimum condensing temperature, while in refrigeration the difference $\Delta T$ can be from 8° F. to 15° F. with an 86° F. minimum condensing temperature.

I have previously improved the cooling capacity and efficiency of refrigeration systems. As disclosed in my U.S. Pat. No. 4,599,873, this is accomplished by addition of a liquid pump at the outlet of the receiver or condenser. Operation of the pump adds 5–12 p.s.i. of pressure to the condensed refrigerant flowing into the expansion valve, a process I call liquid pressure amplification. This suppresses flash gas and assures a uniform flow of liquid refrigerant to the expansion valve, substantially increasing cooling capacity and efficiency. The best results are obtained when such a system is operated with the condenser at moderate ambient temperatures, usually under 80° F. As ambient temperatures rise above the minimum condensing temperature, the advantages gradually decrease. The same thing happens when the principles of my prior invention are applied to air conditioning, except that the minimum condensing temperature is higher.

While conventional air-conditioning systems can benefit from my prior invention, the greatest need for air conditioning is when ambient temperatures are high, over 80° F. Conventional air conditioning becomes less effective and efficient as ambient temperatures rise to 100° F. or more, as does use of my prior liquid refrigerant pressure amplification technique.

It is,.therefore, an object of the invention to improve the efficiency of refrigeration and air-conditioning systems.

Another object of the invention is to increase the cooling capacity of such systems when operated at high ambient temperatures.

A further object of the invention is to enable the aforementioned objects to be attained economically and by retrofitting existing systems as well as in new systems.

The present invention is an improvement in the structure and method of operation of an air-conditioning or refrigeration system which includes a compressor, a condenser, an expansion valve, an evaporator, and conduit means interconnecting the compressor, condenser, expansion valve and evaporator in series in a closed loop for circulating refrigerant therethrough, and optionally may include a receiver between the condenser and expansion valve. The conduit means includes first conduit means coupling an outlet of the compressor to an inlet to the condenser to convey superheated vapor refrigerant from the compressor into the condenser at a first pressure and temperature. A centrifugal pump means has an inlet coupled to an outlet of the condenser (or to the receiver outlet) for receiving condensed liquid refrigerant at a second pressure less than said first pressure and boosting the second pressure of the condensed liquid refrigerant by a substantially constant increment of pressure within a predetermined range to discharge the condensed liquid refrigerant from an outlet of the pump means at a third pressure greater than said second pressure. A second conduit means couples the outlet of the pump means to an inlet to the expansion valve to transmit a first portion of the condensed liquid refrigerant from outlet of the pump means at said third pressure through the expansion valve into the evaporator to vaporize and effect cooling for air conditioning or refrigeration. A third conduit means couples the outlet of the pump means to an inlet to the condenser to transmit a second portion of the condensed liquid refrigerant from outlet of the pump means into the inlet of the condenser to vaporize therein. The portion of the condensed liquid refrigerant injected into the condensor inlet cools the superheated vapor refrigerant entering the condenser to a reduced temperature, thereby reducing said first pressure.

The first and second conduit means are preferably proportioned so that the second portion of refrigerant is sufficient to reduce the first temperature to a reduced temperature close to a saturation temperature of the refrigerant, preferably within 10° F. to 15° F. above saturation temperature, and so that the second portion of refrigerant is substantially less than the first portion, preferably less than about 5% of the first portion and typically in the range of 2%–3% of the first portion. Suitably, the first and second conduit means are proportioned with a cross-sectional area ratio of about 16:1. The system preferably further includes means responsive to a temperature of the evaporator for modulating the expansion valve.

In the improved method of operation, superheated vapor refrigerant is transmitted from the compressor to an inlet to the condenser at a first temperature and pressure. The vapor refrigerant is condensed and discharged as liquid refrigerant at a second temperature and pressure less than said first temperature and pressure. The pressure of the liquid refrigerant discharged from the condenser (or receiver) is boosted to a third pressure greater than the second pressure by a substantially constant increment of pressure. Then, in accordance with the invention, a first portion of the liquid refrigerant is transmitted at said third pressure via the expansion valve into the evaporator and a second portion thereof is transmitted into the condenser inlet so that the first temperature of the superheated vapor refrigerant is reduced toward said second temperature, thereby reducing said first pressure.

The first and second portions of liquid refrigerant at said third pressure are proportioned so that the first portion is substantially greater than the second portion. Preferably, the added increment of pressure is 8 to 10 p.s.i. and the second portion has a flow rate less than 5% of the flow rate of the first portion. The flow of the first portion through the expansion valve can be modulated in response to a temperature in the evaporator.

Prior art ammonia-refrigeration systems are known in which a portion of liquid refrigerant is injected from the receiver to the condenser inlet to suppress superheat. This has not been done, however, in combination with adding an incremental pressure, for example by means of a centrifugal pump, to the pressure of the liquid refrigerant flowing into the expansion valve.

Operation with an added incremental liquid refrigerant pressure preferably includes allowing the first pressure to float with an ambient temperature. This reduces overall system pressures, thereby increasing system efficiency at moderate ambient temperatures. The present invention desuperheats the compressed refrigerant vapor as it enters the condenser, lowering its temperature and further reducing the first pressure, even when ambient temperatures are high. The invention thus raises the temperature range over which benefits can be obtained from adding an increment of pressure to the liquid refrigerant. This further improves efficiency and enables effective operation in very high ambient temperature environments.

The foregoing and other objects, features and advantages of the invention will become more readily apparent from the following detailed description of a preferred embodiment of the invention which proceeds with reference to the accompanying drawings.

DETAILED DESCRIPTION

To understand how we can improve the refrigeration cycle we must first analyze the components of a conventional air-conditioning system and understand where the inefficiencies exist.

Figure 1:
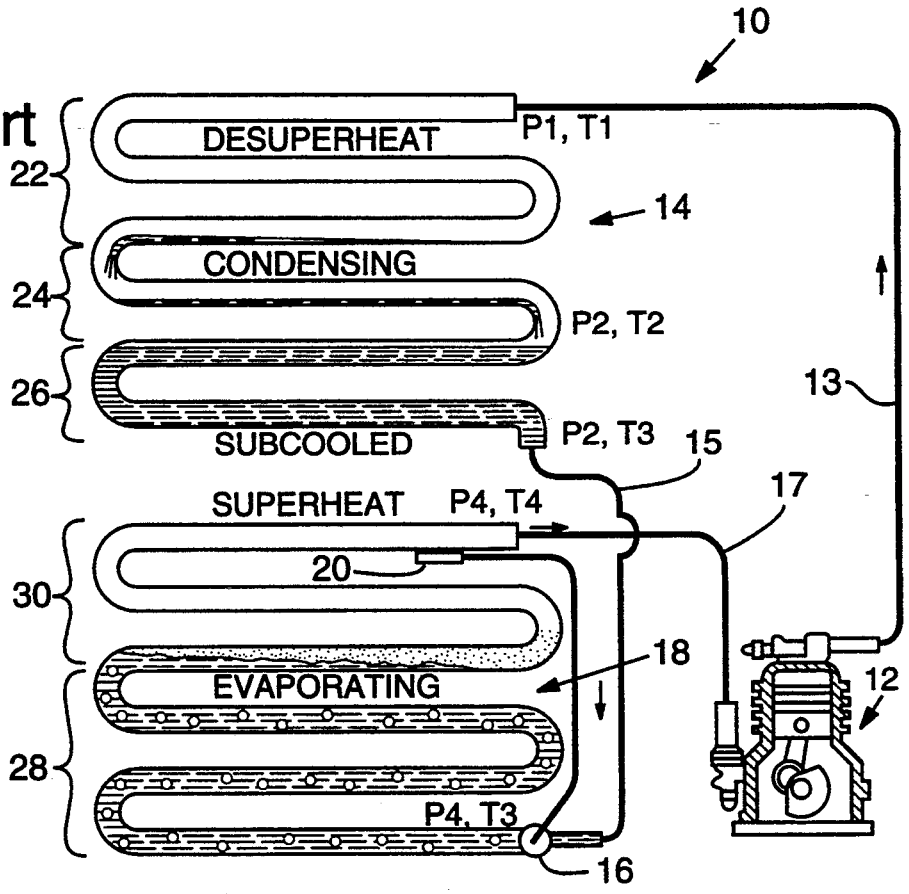
FIG. 1 Prior Art
FIG. 1 is a schematic diagram of a conventional air-conditioning system, with the condenser and evaporator shown in cross section and shaded to indicate regions occupied by liquid refrigerant during condensation and evaporation.

FIG. 1 depicts the conventional air-conditioning circuit 10. The circuit of FIG. 1 consists of the following elements: a compressor 12, condenser 14, expansion valve 16, and evaporator 18 with temperature sensor 20 coupled controllably to the expansion valve, connected in series by conduits 13, 15, 17 to form a closed loop system. Shading indicates that the refrigerant within the condenser passes through three separate states as it is converted back to a liquid form: superheated vapor 22, condensing vapor 24 and subcooled liquid 26. Similarly, shading in the evaporator indicates that the refrigerant contained therein is in two states: vaporizing refrigerant 28 and superheated vapor 30. Pressures and temperatures are indicated at various points in the refrigeration cycle by the variables P1, T1, P2, T2, etc.

In the evaporator, only the refrigerant changing from a liquid state 28 (P4, T3) to a vapor state 30 (P4, T4, assuming $\Delta P$ small) provides refrigerating effect. The more liquid refrigerant (state 28) in the evaporator, the higher its cooling capacity and efficiency. The ratio of liquid to vapor refrigerant can vary. The determining factors are the performance of the expansion valve, the proportion of "flash gas" entering the evaporator through the valve, and the temperature T3 and pressure P4 of the entering liquid refrigerant.

As can be seen in FIG. 1, only superheated vapor (state 30) enters the compressor 12. The term "superheat" refers to the amount of heat in excess of the latent heat of the vaporized refrigerant, that is, heat which increases its volume and/or pressure. High superheat at the compressor inlet can add considerably to the work that must be performed by other components in the system. Ideally, the vapor entering the compressor would be at saturation, containing no superheat and no liquid refrigerant. In most systems using a reciprocating compressor 12 this is not practical. We can, however, make significant improvements.

The discharge heat of the vapor exiting from the compressor includes the superheat of the vapor entering the compressor plus the heat of compression, friction and the motor added by the compressor. At the entrance of the condenser, all of the refrigerant consists of superheated vapors at pressure P1 and temperature T1. The portion of the condenser needed to desuperheat the refrigerant (state 22) is directly related to the temperature T1 of the entering superheat vapors. Only after the superheat is removed can the vapors start to condense (state 24).

The superheated vapors 22 are subject to the Gas Laws of Boyle and Charles. At a higher temperature T1, they will tend to either expand (consuming more condenser area) or increase the pressures P1 and P2 in the condenser, or a combination of both. The rejection of heat at this point is vapor-to-vapor, the least effective means of heat transfer.

As the vapors enter the condensing portion of the condenser they are at saturation (state 24) and at a pressure P2 and temperature T2 which are less than P1 and T1, respectively. At this stage, further removal of latent heat will convert the vapors into the liquid state 26. The pressure P2 will not further change during this stage of the process.

As the refrigerant starts to condense, the condensation will take place along the walls of the condenser. At this point, heat transfer is from liquid-to-vapor, and produces a more efficient rejection of unwanted heat.

The condensing pressures are influenced by the condensing area (total condenser area minus the area used for desuperheating and the area used for subcooling). The effect of superheat can be observed as both a reduction in condensing area (state 24) and an increase in the overall pressure (both P1 and P2).

In an effort to suppress the formation of flash gas entering the expansion valve, many manufacturers use part of the condenser to further cool or subcool the liquid refrigerant to a lower temperature T3 (state 26). If we consider only the subcooling of the liquid without regard to decreased condensing surface, then we can expect a gain of ½% refrigeration capacity per degree (F.) of subcooling. If we consider the reduction in condensing surface, however, then there is a net loss of capacity and efficiency due to increased condensing temperature T2 and higher head pressure P1.

Analysis of the refrigeration cycle shows that several factors that can be improved. Combining these factors, as described with reference to FIG. 4, can dramatically improve the overall capacity and efficiency of performance.

Figure 2:
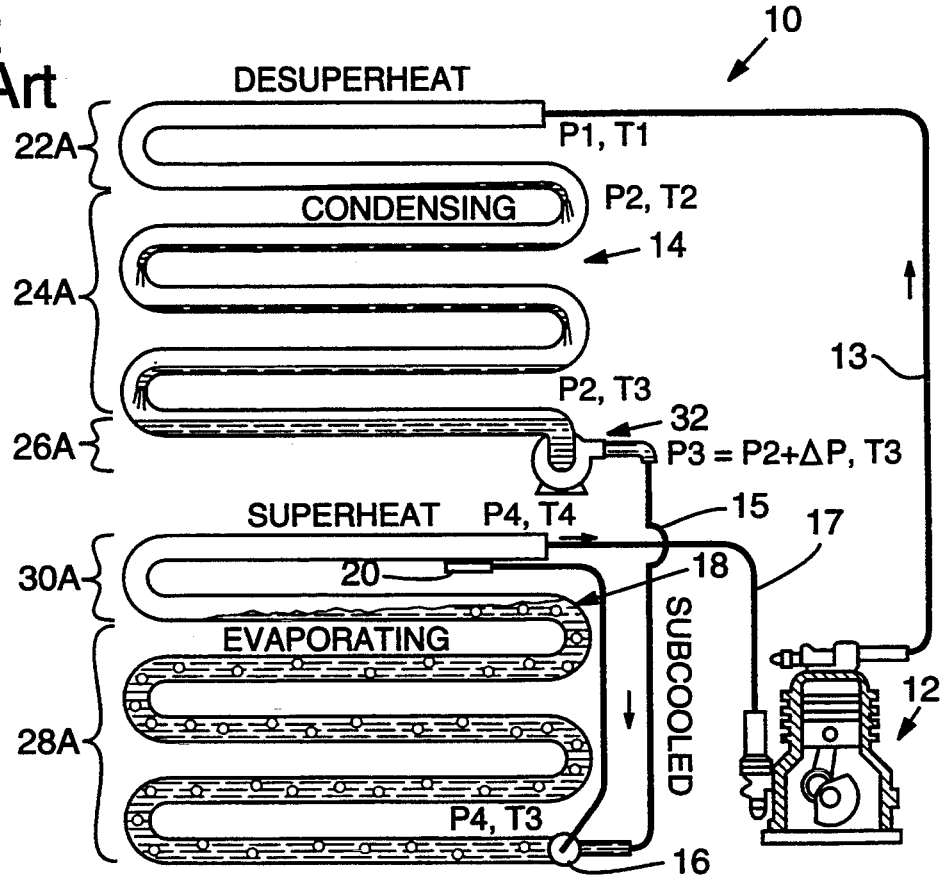
FIG. 2 Prior Art
FIG. 2 is a view similar to FIG. 1 showing the system as modified to include a liquid pump in accordance with the teachings of my prior patent.

FIG. 2 illustrates, in an air-conditioning system, the effects of liquid pumping as taught in my prior U.S. Pat. No. 4,599,873, incorporated herein by reference. The system is largely the same as that of FIG. 1, so like reference numerals are used on like parts. The various states are indicated by like reference numerals followed by the letter "A." Temperatures and pressures are also indicated in like manner with the understanding that the quantities symbolized by the variables differ substantially in each system.

The principal structural difference is that a liquid refrigerant centrifugal pump 32 is installed between the outlet of the condenser 14 (on systems that do not have a receiver) and the expansion valve 16. The pump 32 increases the pressure P2 of the liquid refrigerant flowing from the condenser outlet by a ΔP of 8 to 15 p.s.i. to an incrementally increased pressure P3. This is referred to as the liquid pressure amplification process. The pressure added to the liquid refrigerant will transfer the refrigerant to the subcooled region of the enthalpy (i.e., P3>P2, T3 same, and will not allow the refrigerant to flash prematurely, regardless of head pressure. By eliminating the need to maintain the standard head pressure, minimum head pressure P1 can be lowered to 30 p.s.i. above evaporator pressure P4 in air-conditioning and refrigeration systems. Condensing temperature T1 can float rather than being set to a fixed minimum temperature in a conventional system, e.g., 105° F. in R-22 air-conditioning systems. If ambient temperature is 65° F., using a pump 32 in an R-22 air-conditioning system lowers condensing temperature T1 to about 86° F. at full load. Additionally, head pressure P1 is lowered, as next explained.

For the evaporator 18 to operate at peak efficiency it must operate with as high a liquid-to-vapor ratio as possible. To accomplish this, the expansion valve 16 must allow refrigerant to enter the evaporator at the same rate that it evaporates. Overfeeding or underfeeding of the expansion valve will dramatically affect the efficiency of the evaporator. Using pump 32 assures an adequate feed of liquid refrigerant to valve 16 so that the exhaust refrigerant at the intake of compressor 12 is at a temperature T4 and pressure P4 closer to saturation.

Figure 3:
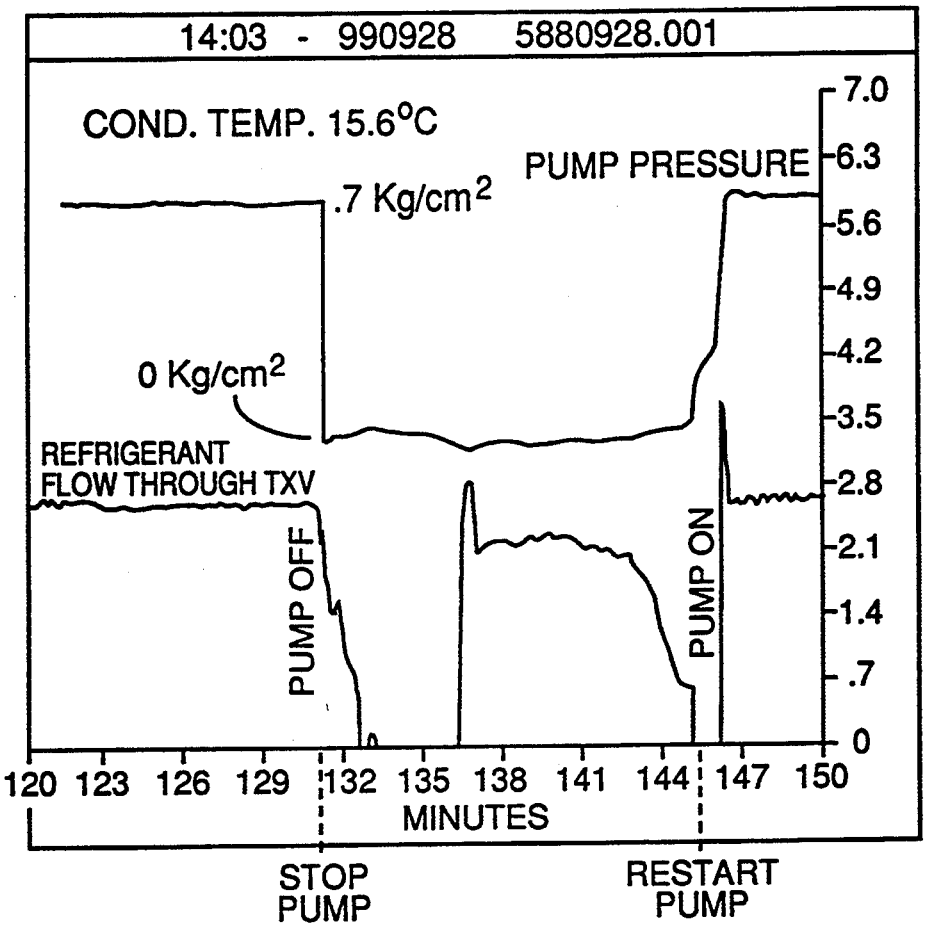
FIG. 3 is a graph of certain parameters of operation of the system of FIG. 2 with the liquid pump ON and OFF.

FIG. 3 graphs the flow rate of refrigerant through the expansion valve 16 in laboratory tests with and without the liquid pump 32 running. The upper trace indicates incremental pressure added by pump 32 and the lower trace graphs the flow rate of refrigerant through the expansion valve. The test begins with the system running in steady state with centrifugal pump 32 ON. At 131 min. the pump was turned OFF. The flow rate of refrigerant entering the evaporator 18 through the expansion valve 16 (TXV) shows a decided decrease in flow compared to the flow when the pump is running. An increase in head pressure only partially restores refrigerant flows. The reduced flow of refrigerant to the evaporator has several detrimental effects, as shown in FIG. 1. Note the reduced effective evaporator area 28 as compared to area 28A in FIG. 2.

At 150 min., the liquid pump 32 is turned ON. With the pump 32 again running, the flow rate is consistently higher, with an even modulation of the expansion valve, because of the absence of flash gas. It can be seen that running the pump increases the amount of refrigerant in the evaporator yet the superheat setting of the valve controls the modulation of the expansion valve at a consistent flow rate. The net result is a greater utilization of the evaporator 8 as shown in FIG. 2 (note state 28A).

The efficiency of the compressor 12 is related to a number of factors, most of which can be improved when the liquid pumping system is applied. The efficiencies can be improved by reducing the temperature in the cylinders of the compressor, by increasing the pressure P4 of the entering vapor, and by reducing the pressure P1 of the exiting vapor. With the vapor entering the compressor at a higher pressure, the compressor capacity will increase. With cooler gas (T4) entering the cylinders, the heat retained in the compressor walls will be less, thereby reducing the expansion, due to heat absorption, of the entering vapor.

With these improvements on the suction side of the compressor, the condensing temperature T1 can float with the ambient to a lower condensing temperature in the system of FIG. 2. This reduces the lift, or work, of the compressor by reducing the difference between P4 and P1. The increased capacity or power reduction, due to the lower condensing temperatures, will be approximately 1.3% for each degree (F.) that the condensing temperature is lowered. As explained earlier, the liquid pump's added pressure ΔP maintains all liquid leaving the pump 32 in the subcooled region of the enthalpy. For this reason, it is no longer necessary to flood the bottom part of the condenser (See 26 in FIG. 1) to subcool the refrigerant. This portion of the condenser can now be used to condense vapor (Compare state 24A of FIG. 2 with state 24 in FIG. 1). This increased condensing surface can further lower the condensing temperature T2 and pressure P2. The temperature T3 of the refrigerant leaving the condenser will be approximately the same as if subcooled, but with little or no subcooling (state 26A).

With the application of the pump 32, the evaporator discharge or superheat temperature T4 and compressor intake pressure P4 have been reduced considerably from the corresponding parameters in the system of FIG. 1.

The best results are obtained when such a system is operated with the condenser at moderate ambient temperatures, usually under 80° F. As ambient temperatures rise above the minimum condensing temperature, the advantages gradually decrease. At a typical ambient temperature of around 75° F., a typical improvement in efficiency of the system of FIG. 2 over that of FIG. 1 is 7%–10%, declining to negligible at 100° F. ambient temperature.

I have discovered, however, that, by using the present invention, next described, an additional 6% to 8% savings can be achieved under typical ambient conditions. Moreover, we can obtain very substantial improvements of efficiency and effectiveness at ambient temperatures over 100° F.

Figure 4:
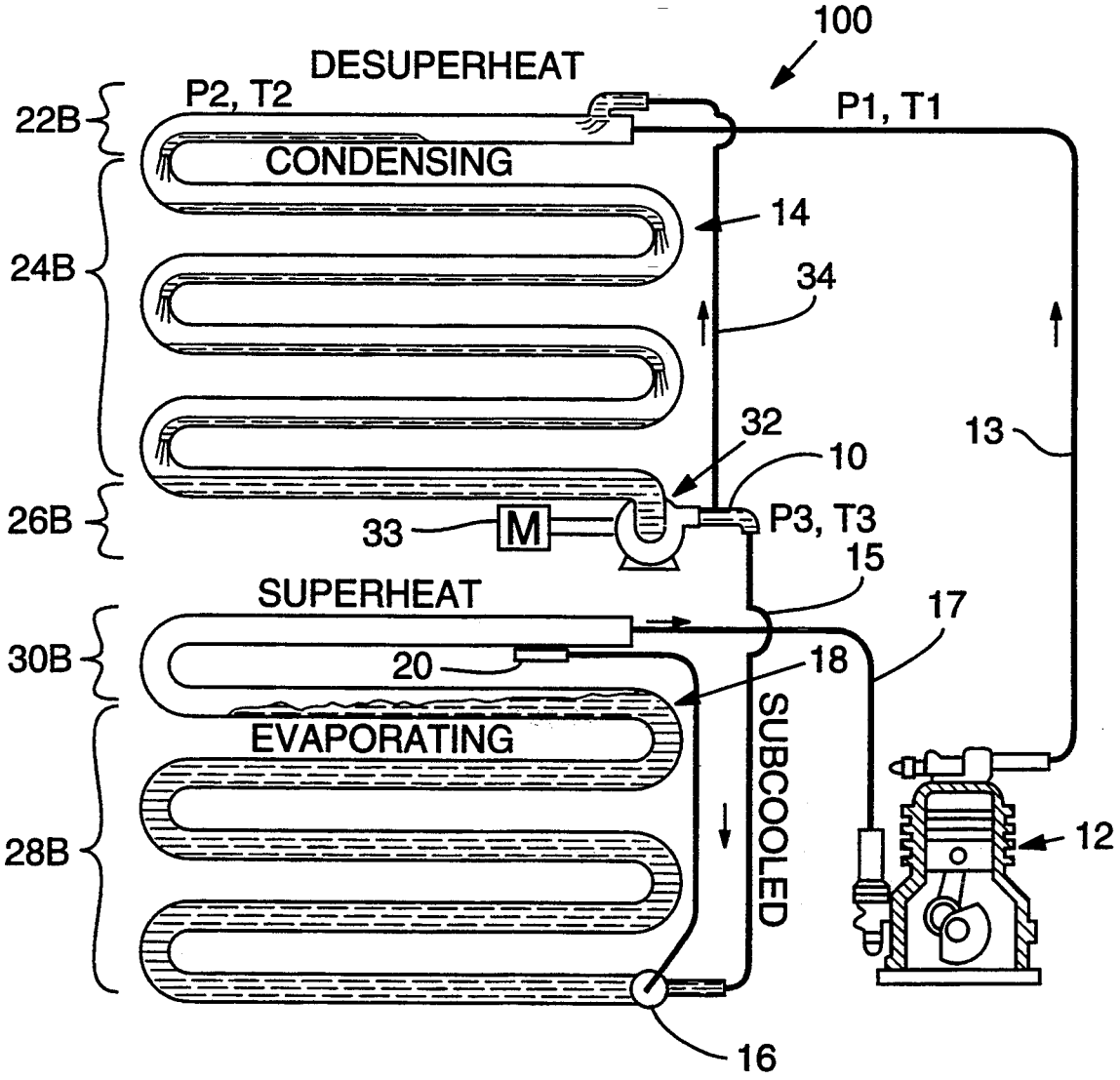
FIG. 4 is a a view similar to that of FIG. 2 showing the system as further modified for superheat suppression in accordance with the present invention.

FIG. 4 shows an air-conditioning system 100 in accordance with the present invention. The general configuration of the system resembles that of system 10A in FIG. 2. In accordance with the invention, however, a conduit or line 34 is connected at one end to the outlet of pump 32 and at the opposite end to an injection coupling 36 at the entrance to the condenser. This circuitry enables a portion of the condensed liquid refrigerant to be injected at temperature T3 from the pump outlet into the entrance of condenser. As this liquid refrigerant enters the desuperheating portion of the condenser, it will immediately reduce the temperature of, and thereby suppress, the superheated vapors entering the condenser at pressure P1 and temperature T1.

The amount of refrigerant injected at coupling 36 should be sufficient to dissipate the superheated vapors and preferably reduce the incoming temperature T1 to a temperature close (within 10° F.–15° F.) to the saturation temperature T2 of the refrigerant. In a 10 ton, 120,000 BTU air-conditioning system, line 15 has an inside diameter of ½ inch and line 34 has an inside diameter of ⅛ inch, for a cross-sectional ratio of line 34 to line 15 of 1:16 or about 6%. Due to flow rate differences and variations (e.g., due to modulation of valve 16 by sensor 20) the flow ratio is less than about 5%, probably 2%–3%, in a typical application.

Suppression of superheated vapor will have four effects:

(1) By reducing the superheat temperature T1, the pressure P1 and volume of the superheat vapors will both be reduced.

(2) The vapor will be very close to or at saturation point (T2, P2).

(3) Condensing will occur closer to the inlet of the condenser.

(4) Heat transfer will be higher because of liquid-to-vapor heat transfer over a greater area of the condenser (compare state 24B with state 24A).

The injection of liquid refrigerant into the condenser 14 is accomplished using the same pump 32 that is installed for the liquid pressure amplification process. Preferably, pump 32 powered by a capacitor-start motor through a magnetic pump drive 33. By reducing the work required to desuperheat the refrigerant vapor, the pump can perform a substantial portion of the work required to recirculate the liquid through the condenser. Although some gain can be seen at low ambient temperature, with this process of superheat suppression, the best gains will be realized at higher ambient temperature. This is just the opposite of the benefits noted with liquid refrigerant amplification alone. For example, at over 100° F., the system of FIG. 2 gives little if any increase in efficiency and capacity over the system of FIG. 1. Tests have shown that the system of FIG. 4, on the other hand, will provide efficiency increases of 10%–12% at 100° F. and as much as 20% at 113° F., and add capacity to allow air conditioning to be run effectively in the desert.

Figure 5:
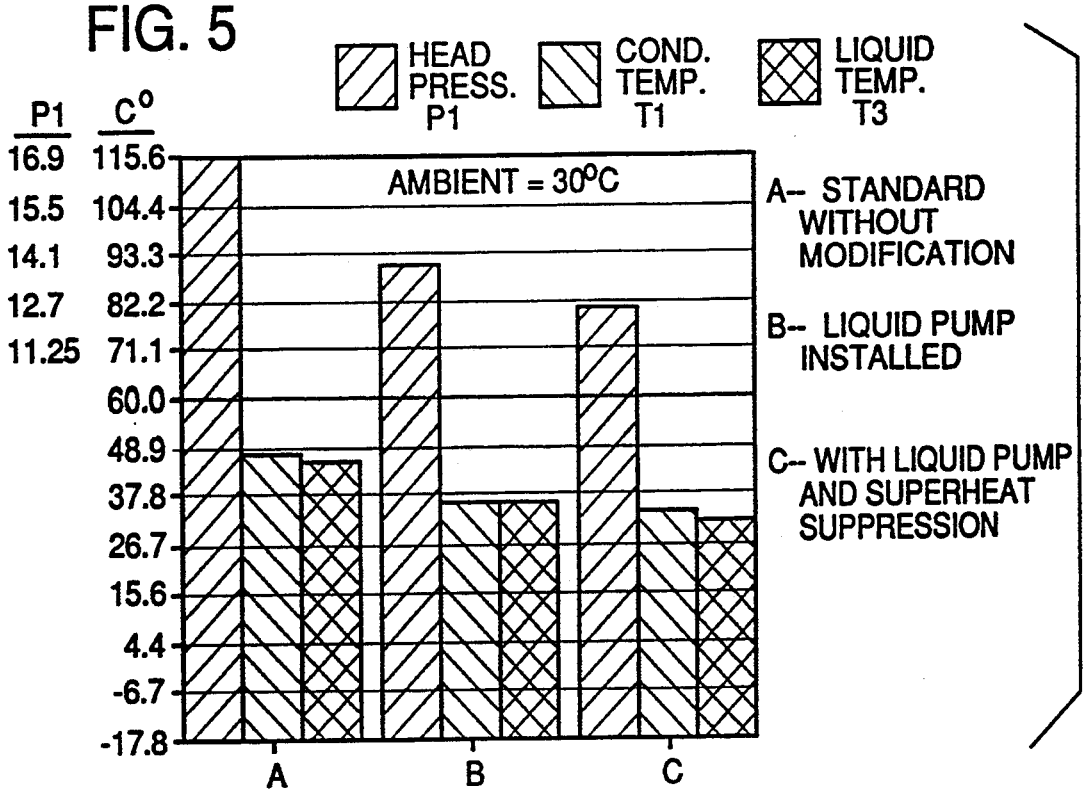
FIG. 5 is a chart of test results comparing three parameters for each of the systems of FIGS. 1, 2 and 4 operating under like ambient conditions.

FIG. 5 is a graph of actual results achieved in a test of a 60 ton Trane air-conditioning system comparing operation of system 100 of FIG. 4 with operation of systems 10 and 10A of respective FIGS. 1 and 2. All readings were taken at 86° F. ambient temperature. The readings are: A. standard system without modification (FIG. 1), B. same system adding the pump 32 only (FIG. 2), and C. the same system modified in accordance with the present invention to include both pump 32 and superheat suppression circuitry 34, 36 (FIG. 4). For each parameter—head pressure P1 (p.s.i.), condensing temperature (T1 (°F.) and liquid temperature T3 (°F.) entering the evaporator—configuration C, the present invention, demonstrated lower readings. Such performance characteristics enable a system 100 according to the present invention to provide a greater cooling capacity as well as greater efficiency. These advantages continue to higher ambient temperatures, including temperatures at which configurations A and B would no longer be effective.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. An air-conditioning or refrigeration system comprising: a compressor, a condenser, an expansion valve, an evaporator, and conduit means interconnecting the compressor, condenser, expansion valve and evaporator in series in a closed loop for circulating refrigerant therethrough, the conduit means including:

first conduit means coupling an outlet of the compressor to an inlet to the condenser to convey superheated vapor refrigerant from the compressor into the condenser at a first pressure and temperature;

a magnetic drive pump having an inlet coupled to an outlet of the condenser for receiving condensed liquid refrigerant at a second pressure less than said first pressure and boosting the second pressure of the condensed liquid refrigerant by a substantially constant increment of pressure within a predetermined range to discharge the condensed liquid refrigerant from an outlet of the pump at a third pressure greater than said second pressure;

second conduit means coupling the outlet of the pump to an inlet to the expansion valve to transmit a first portion of the condensed liquid refrigerant from outlet of the pump at said third pressure through the expansion valve into the evaporator to vaporize and effect cooling for air conditioning or refrigeration; and third conduit means coupling the outlet of the pump to the condenser to transmit a second portion of the condensed liquid refrigerant from an outlet of the pump into condenser together with superheated vapor refrigerant to vaporize therein and effect cooling of the superheated vapor refrigerant entering the condenser to a reduced temperature, thereby reducing said first pressure, the second and third conduit means being proportioned so that the second portion of refrigerant is sufficient to reduce the first temperature of the superheated vapor refrigerant to a reduced temperature close to a saturation temperature of the refrigerant.

2. A system according to claim 1 in which the reduced temperature is less than 5° F. above saturation temperature.

3. A system according to claim 1 in which the second conduit and third means are proportioned so that the second portion of refrigerant is substantially less than the first portion.

4. A system according to claim 3 including means responsive to a temperature of the evaporator for modulating the expansion valve.

5. A system according to claim 1 in which the second and third conduit means are proportioned so that the second portion of refrigerant is substantially less than the first portion.

6. A system according to claim 4 in which the second portion of refrigerant is less than about 5% of the first portion.

7. A system according to claim 4 in which the second portion of refrigerant is in the range of 2%–3% of the first portion.

8. A system according to claim 5 including means responsive to a temperature of the evaporator for modulating the expansion valve.

9. A system according to claim 1 in which the second and third conduit means are proportioned with a cross-sectional area ratio of about 16:1 and the system includes means responsive to a temperature of the evaporator for modulating the expansion valve.

10. A system according to claim 1, wherein the magnetic drive pump comprises:

motor means for driving the pump; and a magnetic pump drive connecting the motor means to the pump to drive the pump.

11. A system according to claim 1, wherein the pump comprises a single pump.

12. A system according to claim 1, wherein the compressor comprises a reciprocating compressor.

* * * * *

UNITED STATES PATENT AND TRADEMARK OFFICE

CERTIFICATE OF CORRECTION

PATENT NO. : 5,386,700

DATED : February 7, 1995

INVENTOR(S) : Robert E. Hyde

It is certified that error appears in the above-identified patent and that said Letters Patent is hereby corrected as shown below:

Column 1, line 54, change "It is,." to --It is--;

Column 6, line 6, change "8" to --18--;

Column 7, line 34, change "pump 32 powered" to --pump 32 is powered--;

Column 8, Claim 3, line 2, change "conduit and third" to --and third conduit--

Column 8, Claim 4, line 1, change "claim 3" to --claim 1--.

Signed and Sealed this

Twenty-ninth Day of April, 1997

*Attest:*

*Attesting Officer*

BRUCE LEHMAN

*Commissioner of Patents and Trademarks*